US005195448A

United States Patent [19]

Sims

[11] Patent Number: 5,195,448

[45] Date of Patent: Mar. 23, 1993

[54] SECURITY SYSTEM

[76] Inventor: Allen G. Sims, #01315-192 "J" Unit, 3901 Klein Blvd., Lompoc, Calif. 93436

[21] Appl. No.: 801,420

[22] Filed: Dec. 2, 1991

[51] Int. Cl.[5] ..... E05G 5/02

[52] U.S. Cl. ..... 109/6; 109/7; 109/8; 109/31; 49/42

[58] Field of Search ..... 109/8, 3, 6, 7, 20-21, 109/29, 31-32, 35, 67-68; 49/43, 42

[56] References Cited

U.S. PATENT DOCUMENTS

| | | | |
|---|---|---|---|
| 4,060,039 | 11/1977 | Lagarrigue | 109/8 |
| 4,063,519 | 12/1977 | Pretini | 49/42 |
| 4,461,221 | 7/1984 | Schandle et al. | 109/3 |
| 4,481,887 | 11/1984 | Urbano | 109/3 |
| 4,656,954 | 4/1987 | Tonali | 109/6 |
| 4,741,275 | 5/1988 | Lewiner et al. | 109/7 |
| 4,841,752 | 6/1989 | Fletcher | 109/29 |
| 4,848,246 | 7/1989 | Rosen | 109/29 |
| 4,867,076 | 9/1989 | Marcone | 109/29 |
| 4,928,429 | 5/1990 | Colombo | 49/42 |

FOREIGN PATENT DOCUMENTS

| | | | |
|---|---|---|---|
| 0087977 | 9/1983 | European Pat. Off. | 49/42 |
| 2268149 | 11/1975 | France | 49/42 |
| 2334809 | 7/1977 | France | 109/8 |
| 2508965 | 1/1983 | France | 109/7 |
| 7308642 | 7/1973 | Netherlands | 109/7 |

*Primary Examiner*—Renee S. Luebke
*Assistant Examiner*—D. Boucher
*Attorney, Agent, or Firm*—Bauer & Schaffer

[57] ABSTRACT

An anti-armed robbery system is provided wherein persons enter and exit an establishment through a plurality of floor to ceiling extending walls and lockable doors made of bullet resistant materials forming a completely enclosed bullet resistant vestibule, having means for detecting the entry and exit of persons, and means responsive thereto for allowing the unhampered entry to the establishment of entering persons, and not allowing exit from the vestibule of persons exiting the establishment, unless so enabled by an employee of the establishment. Elongated, vertically oriented anti-jamming panels are provided in the doorway, which rotate about a vertical axis so that a lateral edge of the panel projects into the doorway and rotates in a direction so as to eject into the vestibule an object or person obstructing the closure of the door.

6 Claims, 5 Drawing Sheets

SECURITY SYSTEM

RELATED SUBJECT MATTE

The present application contains subject matter contained in disclosure Document No. 259,216 filed Aug. 1, 1990.

BACKGROUND OF INVENTION

The present invention relates to security systems, and more particularly to a system for the prevention of armed robberies and the apprehension of armed robbers.

In these troubled times, armed robbery has become a plague upon retail business establishments. The occurrence of armed robberies is continually on the rise as a result of widespread drug abuse, unemployment, and dwindling governmental resources for patrol, investigation, and enforcement. The problems created by armed robberies include possible injury or death to employees and customers, and the potential liability therefor upon the establishment owner, not to mention the loss of money and property.

The most common means of addressing these problems involves the purchase of insurance, however, this addresses only the monetary consequences which arise after the fact, and does nothing to actually prevent armed robberies. Furthermore, the ever escalating costs of insurance and other forms of loss prevention places a substanti-al financial burden upon the establishment owner, which must ultimately be passed along to the consumer, and in turn makes the business less competitive. This is particularly burdensome to businesses dealing in large amounts of money or valuable goods, such as drug stores, liquor stores, banks, jewelry stores, furriers, and the like, as well as businesses that are considered high risk due to location in high crime areas, or have late hours of operation, such as hotels, supermarkets, 24 hour convenience stores, restaurants, gas stations and the like.

Another well known form of armed robbery protection involves the use of closed circuit cameras, which can be rendered virtually useless by covering of the lenses, or the use of disquises by the perpetrator. Even if these cameras are not defeated, their photos must be compared to those of known criminals, which is quite a time consuming process for the local enforcement authorities, and relies upon the previous arrest of the robber. Using this method, even if the robber is apprehended, it is at a point sufficiently remote in time to make the recovery of lost property extremely unlikely.

Yet another form of robbery protection involves the employment of armed guards. Not only does this add significantly to the business' expenses, armed robberies in such establishments usually begin with the disarming of these guards, whereupon the weapon taken from the guard is sold on the black market, thereby enabling another miscreant to perpetrate more armed robberies. Of course, the guard is additionally a potential viction of death or injury in such a scenario.

Still another well known form of robbery protection involves the use of a remotely unlockable door for the entry and exit of business patrons. Such a system can discourage the entry of customers because they must await the attention of a clerk to unlock the door. Furthermore, once an armed robber is inside and finished collecting his loot, the weapon may then be pointed at the clerk threateningly to persuade the clerk to remotely unlock the door and allow the robber's escape.

OBJECTS AND ADVANTAGE

Accordingly, it is an object of the present invention to provide a system for the prevention of armed robbery of retail establishments.

It is another object of the present invention to provide a system for protecting retail establishments from robbery, while minimizing the aforementioned disadvantages.

It is yet another object of the present invention to provide a system for the safe detention of armed robbers while awaiting the arrival of police.

Still another object of the present invention is to provide a means for reduction of insurance costs for retail establishments.

An advantage of the present invention is achievement of the aforementioned objects while preventing the loss of money and property.

Another advantage of the present invention is the elimination of the need for armed guards at retail businesses.

Yet another advantage of the present invention is the ability to positively identify a robber for easy apprehension by law enforcement officials.

Still another advantage of the present invention is the provision of an anti--robbery system which is readily identifiable by potential armed robbers, while being aesthetically pleasing, easily operated, and which does not discourage the normal entry and exit of business patrons.

A further advantage of the present invention is the active and positive confinement of an armed robber, wherein the active confinement process will not injure a person being confined.

Yet a further advantage of the present invention is the ability to confine and detain an armed robber and summon the police, even after the persons in the establishment have been disabled or killed.

The preceding, as well as other objects, advantages and features of the present invention will become apparent to those of skill in the art upon contemplation of the disclosure herein.

SUMMARY

According to the present invention, an anti- armed robbery system is provided for use in retail establishments comprising a bullet resistant vestibule for the entry and exit of persons, said vestibule having manual or automatic means of being remotely lockable. The vestibule comprises a pair of conventional swinging doors and a hallway therebetween, the doors and hallway walls extending from the floor to the ceiling and being fabricated of bullet resistant materials. The system further comprises a elongated vertically oriented anti-jamming mechanism which rotates about a vertical central axis, one lateral edge of which projects into the doorway so that the rotation of said mechanism will cause an object or person obstructing the closure path of the swinging door to be ejected into the vestibule. The outer of the two swinging doors is augmented by an adjacent motorized sliding door which is controlled so as to slide closed in conjunction with the operation of the anti- jamming mechanism under appropriate circumstances.

Alternatively, the vestibule comprises a remotely lockable revolving door assembly which extends from the floor to the ceiling, with the rotary doors and the curved enclosure walls of the revolving door assembly being fabricated of bullet resistant materials.

The anti- armed robbery system further comprises a vestibule environment control system which informs persons of incorrect operation of the system, or impending automatic operation of the anti- armed robbery system, and can be manually operated to perform functions for the non-lethal incapacitation and identification of a robber trapped therein. The vestibule environment control system comprises a sound system capable of broadcasting the aforementioned warnings and of high volume sound capable of subduing a trapped criminal, and a spray system capable of dispensing marker dye, mace, tear gas, nitrous oxide or the like to identify and or subdue a criminal therein. Additionally, the vestibule environment control system has manually operated means for the energizing of selected interior portions of the vestibule so that stun gun like charges may be imposed upon a criminal trying to escape.

DETAILED DESCRIPTION

Figure 1:
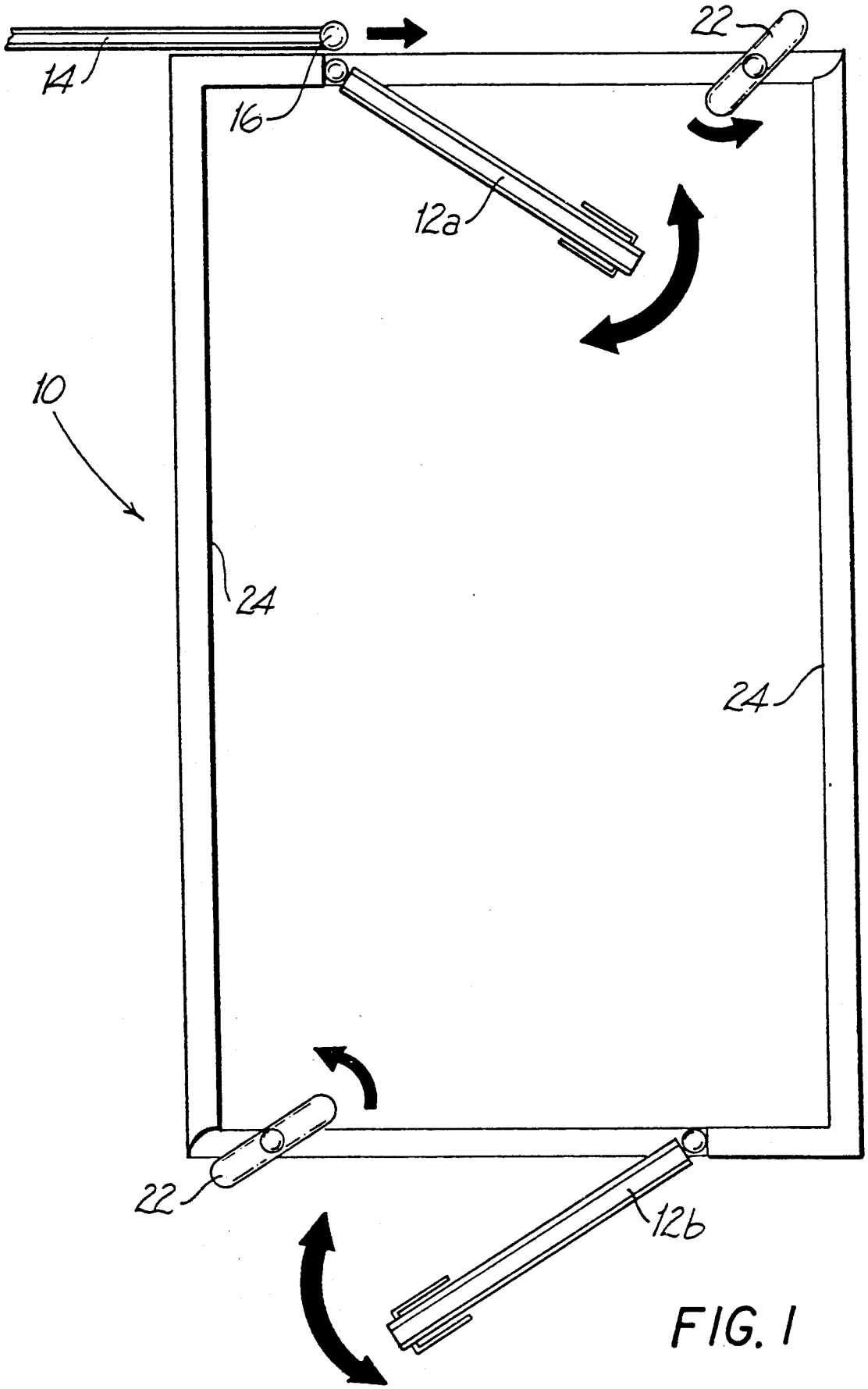
FIG. 1 is a plan view of the vestibule of the present invention as applied to an arrangement of swinging doors.

Turning now to FIG. 1, a plan view of a swinging door embodiment of the anti- armed robbery vestibule is shown, denoted generally by the numeral 10. The swinging door vestibule has a street side inwardly swinging door, 12*a*, and a store side inwardly swinging door, 12*b*. Each of the swinging doors is equipped with a remotely operable lock, not shown. Adjacent the street side swinging door 12*a* is an auxiliary sliding door, 14, having sliding door drive means 16. Drive means 16 shown contemplates a motorized gear 18 shown in FIG. 2 which engages rack gear 20 on the sliding door, however, a wide range of possibilities for operating door 14 will be obvious to those skilled in the art, including belt or chain drives, powered cylinders, etc. In each doorway is an elongated anti- jamming panel 22 which extends the full height of door 12, and rotates about a vertical axis in such a direction so as to dislodge an obstruction in the doorway and eject the obstruction into the vestibule 10. Walls, 24, extend from the floor to the ceiling, and connect the two doorways so as to form a completely enclosed hallway type vestibule therebetween. Door 12, anti- jamming panels 22, sliding door 14, and walls 24 are all constructed using bullet resistant materials such as cement, Lexan, composites, metal, or the like. Thusly constructed, should an armed robber become irate upon being locked in the vestibule, use of weapon would then not preset a hazard to anyone outside the vestibule. FIG. 3 illustrates an aesthetically pleasing potential construction for walls 24 wherein the lower portion 26 is made of cement and brick, upper portion windows, 28, are made of Lexan in bullet resistant thickness, and window frame covers 30 are made of metal or composite such as Kevlar.

Figure 2:
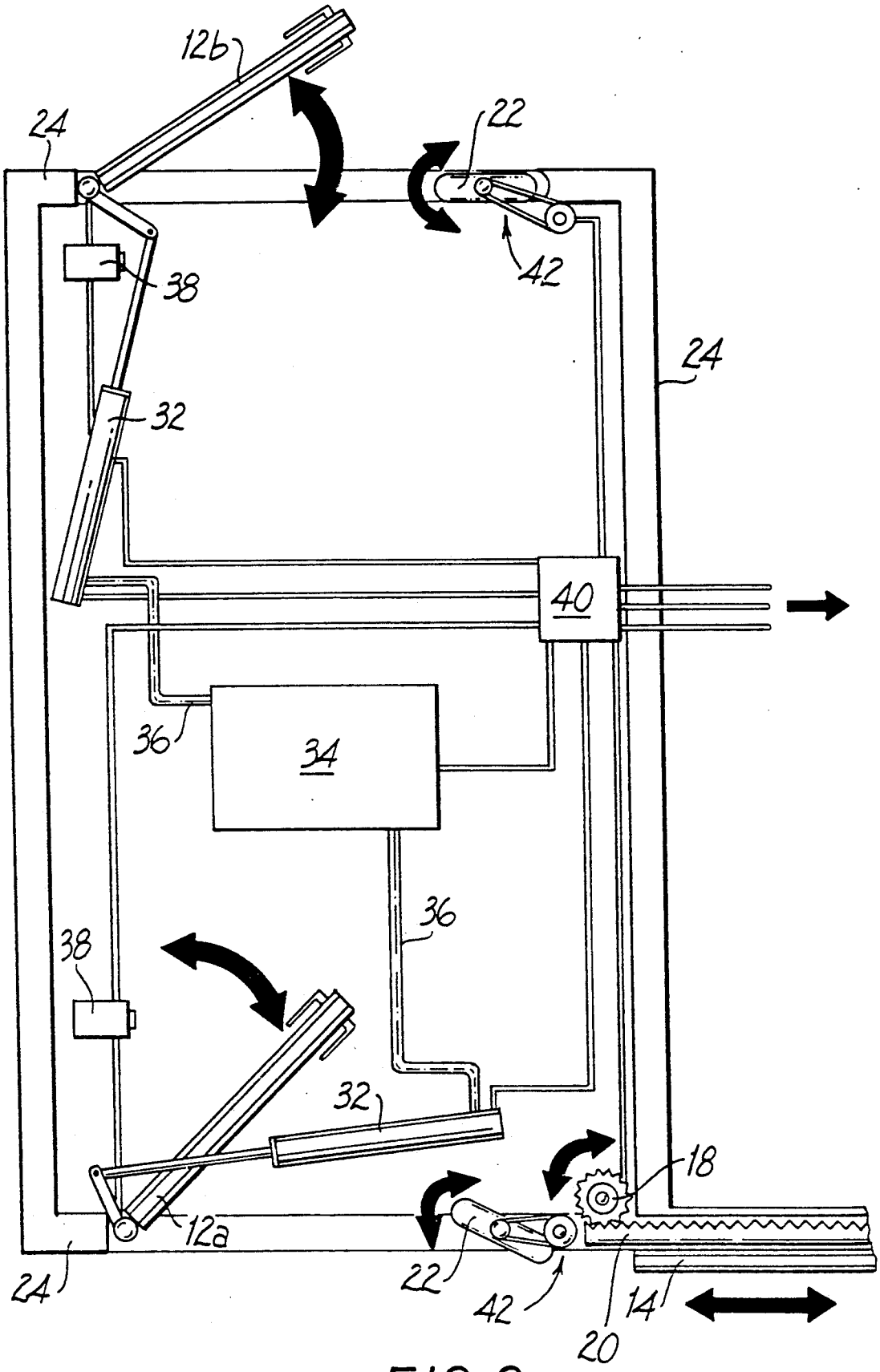
FIG. 2 is a plan view of the swinging door vestibule showing door position sensors and door closing cylinders.
Figure 3:
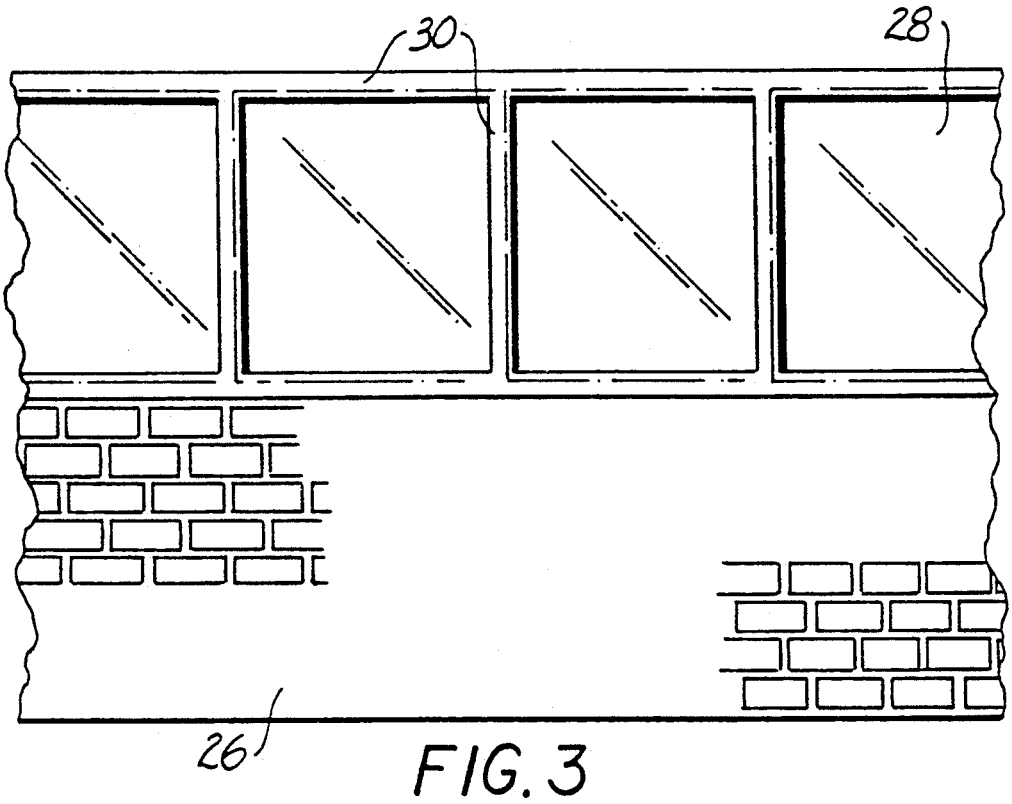
FIG. 3 is an illustration of the vestibule hallway wall.

Turning now to FIG. 2, doorway controls such are shown, including swinging door closers 32 which are shown as power cylinders operated by power unit 34 applying pressurized air or hydraulic fluid to the cylinders via lines 36. Door position sensors 38 are responsively coupled to doors 12 from which output signals are transmitted to the vestibule control box 40 which in turn is coupled via shielded cables to one or more remote operator control units, not shown. Motorized chain drive units 42 are shown coupled to rotate anti-jamming panels 22 the chain drive units likewise being controlled via control box 40.

It should be noted that in FIG. 2 the anti- jamming panel adjacent the outer door 12*a* is shown in a different variation from that of FIG. 1 in that it is mounted to the leading edge of auxiliary sliding door 14 as compared to the stationary mounting of FIG. 1, and that the sliding door of FIG. 2 closes from the opposite side of the swinging door 12*a*, so that the outer doorway can be closed off more quickly than the alternative of FIG. 1.

The control items shown in FIG. 2 are to be located within the ceiling of the vestibule, behind bullet resistant ceiling panels, or alternatively, within bullet resistant enclosures so that breach of system integrity is prevented. Obviously, numerous possibilities for alternative powered door closing mechanisms, door position sensors and door locking mechanisms will be apparent to those skilled in the art, which can be substituted for the arrangements shown without departing from the spirit or scope of the instant invention.

Figure 4:
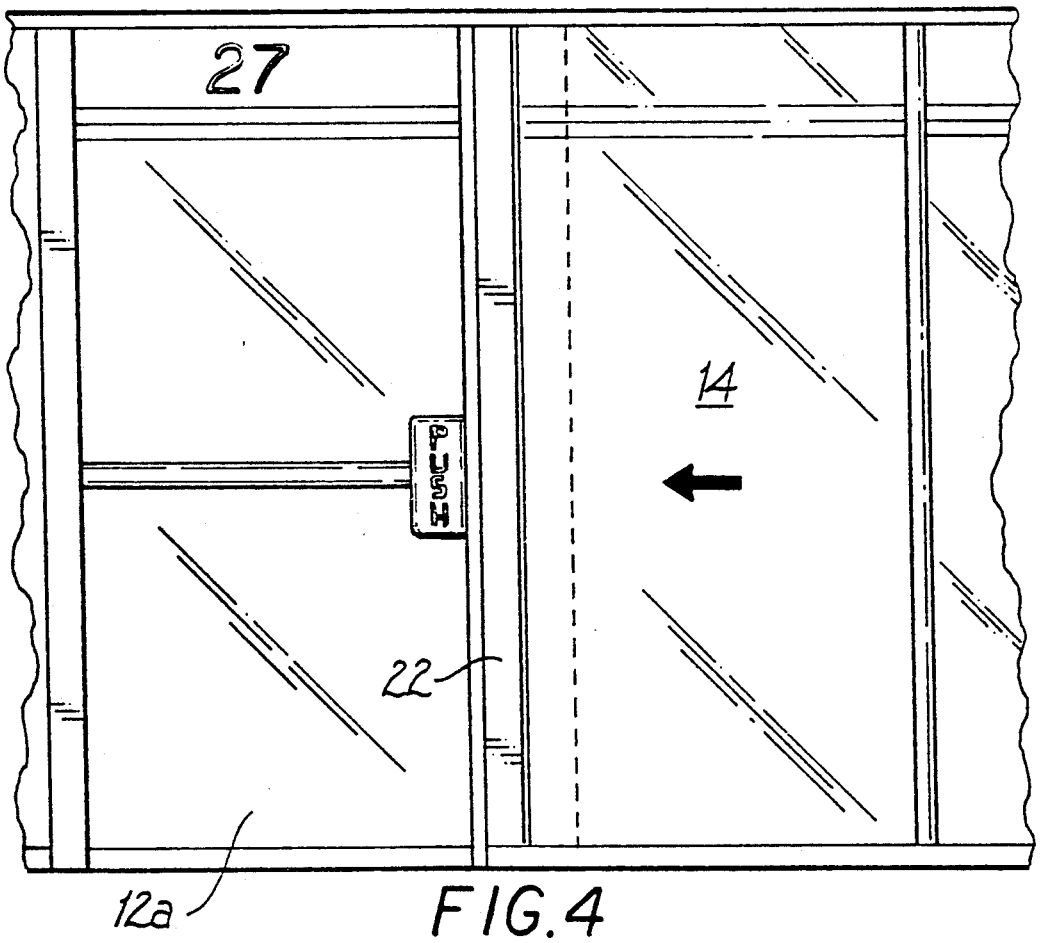
FIG. 4 is an illustration of the street to vestibule entrance, showing the sliding auxiliary door and anti-jamming mechanism.

An illustration of the front of an establishment is shown in FIG. 4, so that the operation of the auxiliary sliding door 14 and anti- jamming panel 22 as shown in FIG. 2 can be appreciated.

Figure 5:
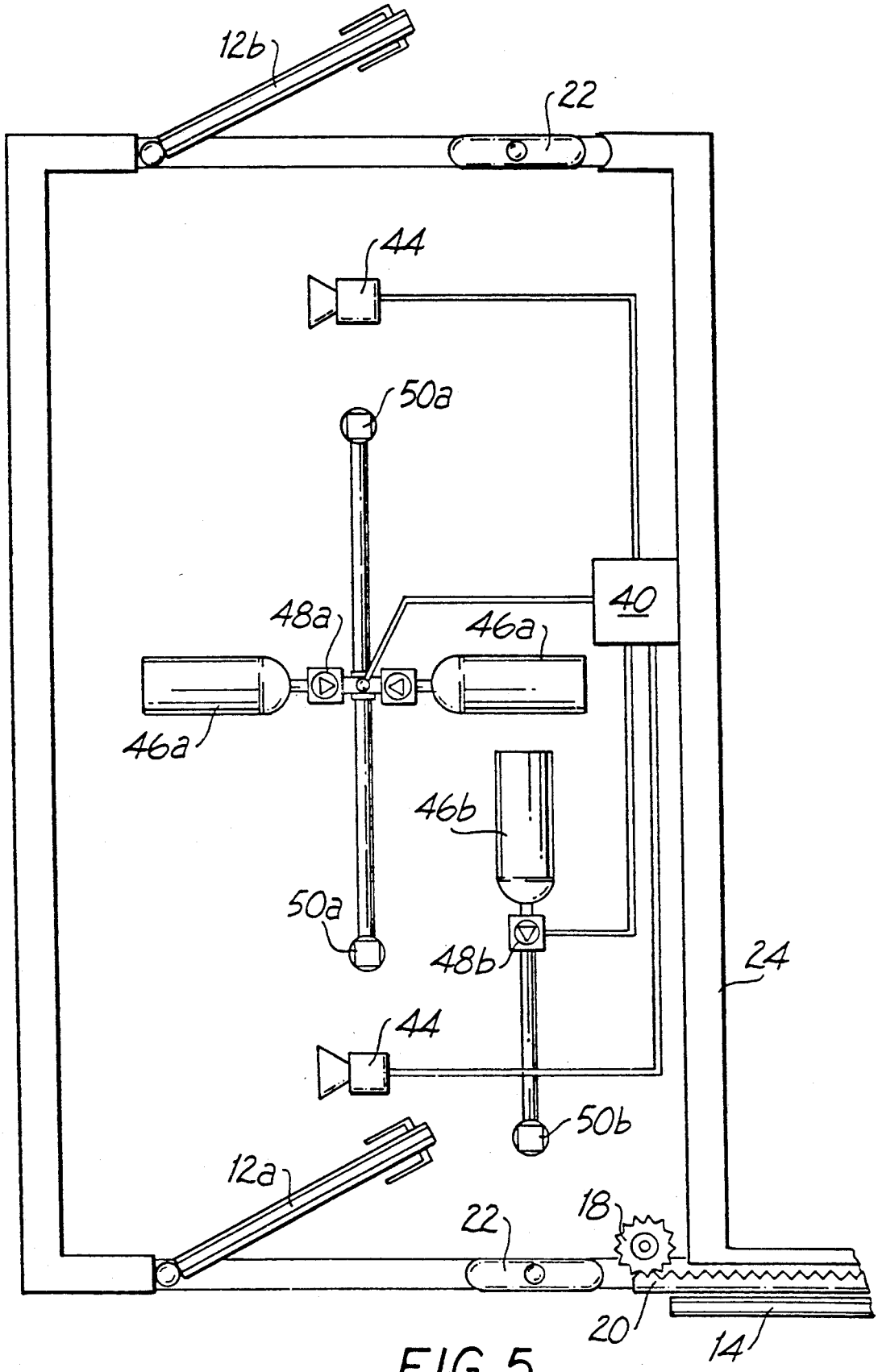
FIG. 5 is a plan view of the present invention showing the vestibule environment control system.

Turning now to FIG. 5, the vestibule environment control is shown, having audio, gas and dye systems. The audio system comprises loudspeakers 44 which are coupled to an amplifier, not shown. Inputs to the amplifier are provided by a remote microphone, a remote message unit and an audio assault unit. The remote message unit, not shown, broadcasts a warning into the vestibule of impending automatic operation of the vestibule doors and anti- jamming panels, and is triggered by the same circumstances as the automatic operation, albeit beforehand. Conditions for automatic operation are selectable to suit the particular installation, based upon inputs from door position sensors 38 integrated system timers, and input from control panels and vestibule occupant detection means. Detection of an occupant in the vestibule can be provided by vestibule floor mat switches, infra- red sensors, video cameras, or any combination of equivalent means. Similarly, the present invention may be integrated with an inventory control system, so as to broadcast a different message and detain a potential shoplifter.

The audio system can be manually controlled to broadcast microphone input to the vestibule, for communication with vestibule occupants, or to broadcast a high volume audio assault into the vestibule so as to subdue the vestibule occupants with painfully loud sound.

The vestibule environment control of FIG. 5 also comprises a gas system having pressurized bottles 46*a* containing mace, tear gas, or the like to be discharged into the locked vestibule upon manual remote operation of solenoid valves 48*a* through nozzles 50*a*. A separate identical gas system is provided to discharge Nitrous Oxide into the vestibule so that vestibule occupants can be sedated, whereby catastrophic consequences of a hostage type situation can be avoided. Likewise, bottle 46*b* contains pressurized dye, which by remote manual control of solenoid valve 48*b* can be sprayed via nozzle 50*b* onto potentially escaping vestibule occupants for each identification by law enforcement authorities.

Figure 6:
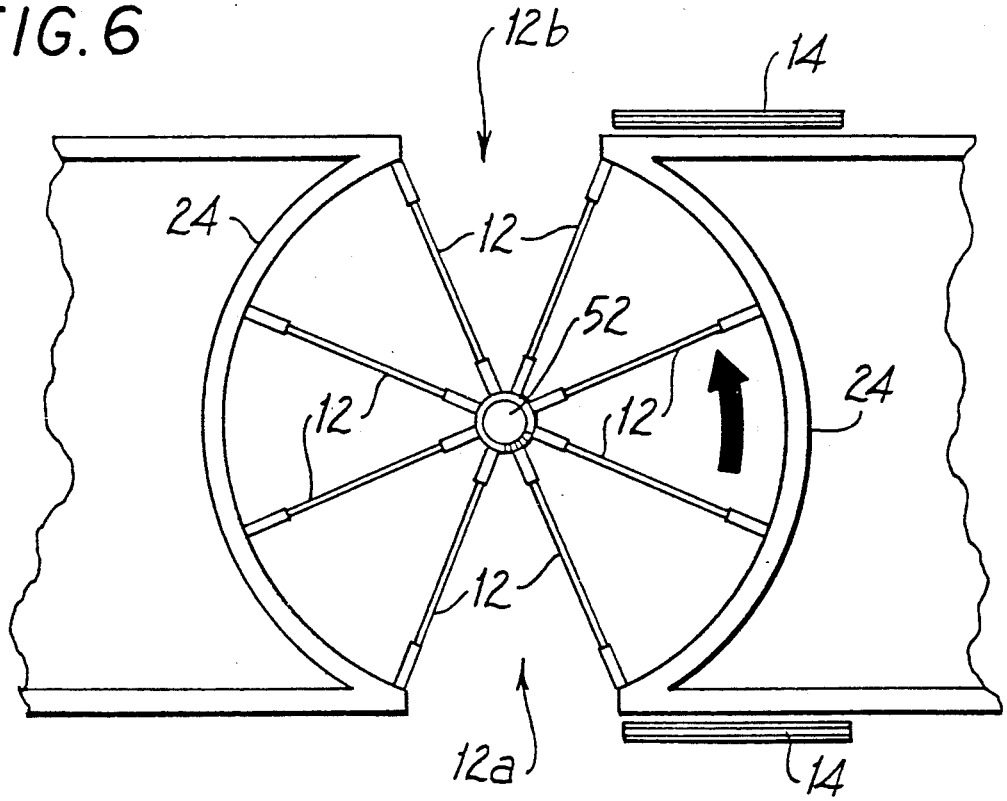
FIG. 6 is a plan view of the revolving door embodiment of the vestibule.

Turning now to FIG. 6, the present invention is shown as applied to a revolving door, having multiple doors 12. Therein, each of door 12 extends from the floor to the ceiling, and are fabricated of bullet resistant material, as is likewise the case with revolving door assembly enclosure walls. The revolving door assembly has unidirectional ratchet means, locking brake means and motorization means located in hub 52 although these may be located elsewhere on the revolving door assembly as will be obvious to those of skill in the art. The revolving door embodiment is shown having an auxiliary sliding door 14 however this is not essential inasmuch as the structure of a revolving door inherently encloses a user completely at some point when passing therethrough. For this reason, anti- jamming panels are likewise unnecessary in the revolving door embodiment of the present invention.

Figure 7:
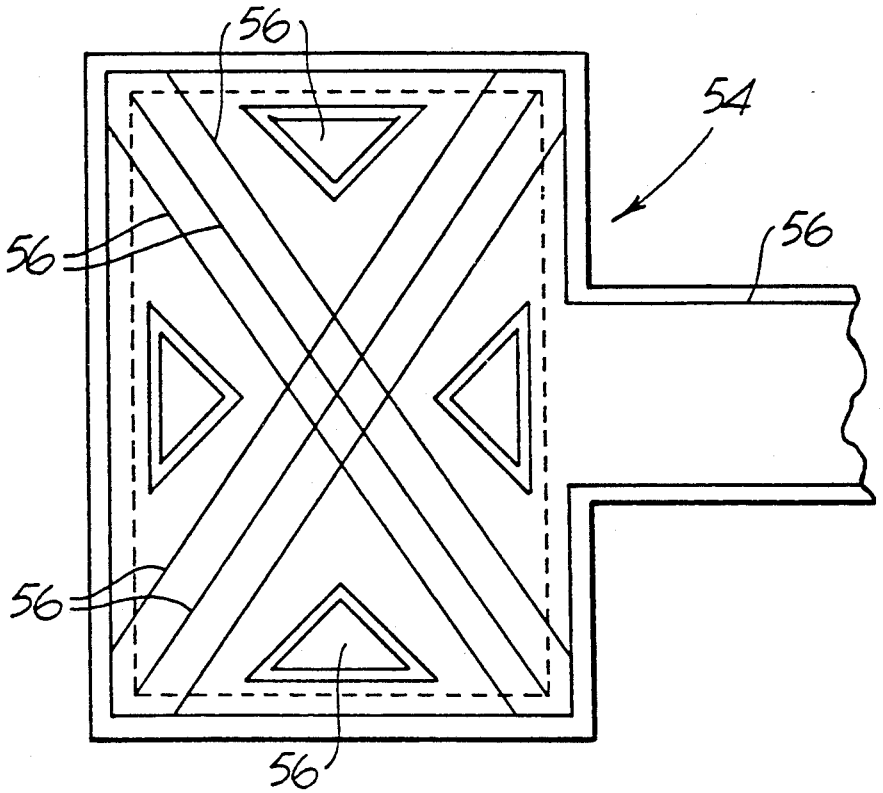
FIG. 7 is a diagrammatic representation of the electric shock vestibule door handle.

Door handle 54 is shown in FIG. 7 as one example of an interior surface of the vestibule to be constructed having exposed conductors 56 therein. Conductors 56 are electrically connected to a remotely controlled stun gun type electrical discharge unit, adapted for manual operation. Such a unit is employed to prevent escape of an agitated confined person with the apparent strength to otherwise overcome or defeat the security vestibule.

Operation of the instant invention is contemplated as follows: In the swinging door embodiment of FIG. 1, opening of either door as detected by door position sensors 38 will cause the opposite door to lock closed. Using simple logic circuitry in conjunction with vestibule occupant detection means and door opening order, it can be determined whether a person is entering or exiting the establishment, e.g., when the vestibule occupant detection means determines the vestibule to be empty, and the outer door 12*a* opens, it can be concluded that a person is entering. Inner door 12*b* is then unlocked upon the closure of door 12*a* and the detected presence of a vestibule occupant, thus allowing a patron to enter normally. On the other hand, if the inner door to an empty vestibule should open first, it can be concluded that a person is exiting the establishment. Upon detection of a vestibule occupant and the subsequent closure of the inner door 12*b* inner door 12*b* is locked, and outer door 12*a* is not unlocked unless the establishment clerk has activated and exit release switch. The exit release switch is to be enabled after the closure of the inner door 12*b*, to prevent the assailant from simply activating the switch himself before leaving. Accordingly, the vestibule should be of sufficient length to allow the clerk time to activate the exit release before an exiting customer encounters locked outer door 12*a*. Should a predetermined time period elapse without the exit being released for an exiting person, an autodialer unit will be activated to summon assistance. Should either door be held open a predetermined time period, the power door closers, auxiliary sliding doors and anti-jamming panels would be activated after broadcast of a warning message. In the case of the revolving door embodiment of FIG. 6, entry or exit of a person can be determined by occupant presence detectors on either side of the vestibule in conjunction with unidirectional door operation. If the establishment clerk has not activated the exit release, the revolving door lock means and auxiliary sliding door would be activated. Again, should a predetermined time elapse without the exit being released for an exiting person, an autodialer unit would be activated to summon assistance. So used, the only control necessary for the establishment clerk would be an exit release switch, ideally in the form of one or more discretely located floor mat switches.

Thus configured, should an armed robbery take place, the clerk need do nothing to activate the system which might tip off and anger the robber. Should the clerk be incapacitated, by being tied up, or locked in a closet out of reach of the panic button of a conventional alarm system, or even if the clerk has been killed by a robber seeking to eliminate witnesses, the anti-armed robbery vestibule of the present invention will trap him.

Operation of audio assaulı, spray and stun systems would be by manual invocation only, for obvious reasons, and can be limited to control from a bullet resistant store security booth, or even a remote facility monitoring one or more equipped establishments. Virtually infinite control algorithm possibilities will be obvious to those skilled in the art, and can be substituted for that above without departure from the spirit or scope of the instant invention. Accordingly, the scope of the instant invention should not be determined by the embodiments shown, but rather by the claims appended hereto and their legal equivalents.

What is claimed is:

1. A security system for controlling the entry and exit of persons from an establishment comprising a substantially enclosed vestibule entry:

at least tow doorways set in the walls of said vestibule, each of said doorways having a door extending from the floor to the ceiling of said vestibule, said doors and walls of said vestibule being made of bullet resistant material;

means for detecting the movement of persons through each of said doorways;

means, responsive to said detection means for selectively controlling the locking of said at least two doors so as to enable a person to pass through or to be detained within said vestibule;

a vertically oriented panel mounted on the edge of the wall abutting the free edge of each of said doors, each of said vertically oriented panels being pivotable about a vertical axis; and means for acting on each of said panels to cause an object placed in the space between the free edge of the associated door and panel to be pushed away from said space so as to prevent the unwanted obstruction of said doorway and/or the wedging of the door in an undesired open condition.

2. The security system as set forth in claim 1, wherein said means for detecting the exit of persons from the establishment includes one or more items from a group consisting of floor mat switches, infra- red sensors and door position sensors.

3. The security system as set forth in claim 1, further comprising remotely controlled means for the non lethal incapacitation of persons detained therein.

4. The security system as set forth in claim 1, further comprising remotely controlled means for the application of dye to a person in the vestibule, so that the ease of identification of the person by enforcement authorities is enhanced.

5. The security system as set forth in claim 1, further comprising means for detecting the position of said doors; an auxiliary bullet resistant door disposed so as to close across one of said doorways; and means for closing said auxiliary door, said closing means being responsive to said means for detecting the positions of said doors.

6. The security system as set forth in claim 1, wherein said remotely controlled means for the non lethal incapacitation of persons includes one or more items from a group consisting of nitrous oxide, mace, tear gas, high volume sound broadcast equipment, and electrically energized vestibule interior portions.

* * * * *